US011328669B2

(12) United States Patent
Qin et al.

(10) Patent No.: US 11,328,669 B2
(45) Date of Patent: May 10, 2022

(54) PIXEL DRIVING CIRCUIT AND DRIVING METHOD THEREOF, DISPLAY PANEL AND DISPLAY DEVICE

(71) Applicant: BOE Technology Group Co., Ltd., Beijing (CN)

(72) Inventors: Wei Qin, Beijing (CN); Xiaolong Li, Beijing (CN); Kuanjun Peng, Beijing (CN); Chunfang Zhang, Beijing (CN); Zhiqiang Xu, Beijing (CN); Yanan Niu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 233 days.

(21) Appl. No.: 16/835,479

(22) Filed: Mar. 31, 2020

(65) Prior Publication Data

US 2021/0142719 A1 May 13, 2021

(30) Foreign Application Priority Data

Nov. 13, 2019 (CN) ..... 201911111274.7

(51) Int. Cl.
*G09G 3/325* (2016.01)
*G09G 3/3258* (2016.01)
(Continued)

(52) U.S. Cl.
CPC ..... *G09G 3/325* (2013.01); *G09G 3/3258* (2013.01); *G09G 3/3266* (2013.01); *G09G 3/3291* (2013.01); *G09G 2300/0852* (2013.01)

(58) Field of Classification Search
CPC .. G09G 3/3225; G09G 3/3291; G09G 3/3258; G09G 3/325; G09G 3/3266;
(Continued)

(56) References Cited

U.S. PATENT DOCUMENTS 6,778,151 B2 * 8/2004 Li ..... G09G 3/3233 315/169.1
9,153,192 B2 10/2015 Jung et al.
(Continued)

FOREIGN PATENT DOCUMENTS

CN 1477611 A 2/2004
CN 103700342 A 4/2014
(Continued)

OTHER PUBLICATIONS

First Office Action, including Search Report, for Chinese Patent Application No. 201911111274.7, dated Aug. 19, 2020, 22 pages.

*Primary Examiner* — Christopher E Leiby
(74) *Attorney, Agent, or Firm* — Westman, Champlin & Koehler, P.A.

(57) ABSTRACT

Embodiments of the present disclosure provide a pixel driving circuit and a driving method thereof, a display panel and a display device. The pixel driving circuit includes: a driving sub-circuit, coupled to a scanning signal terminal, a data signal terminal, a light-emitting control signal terminal, a first voltage signal terminal, and a first terminal of a light-emitting element, and configured to be able to output a first voltage signal from the first voltage signal terminal to the light-emitting element under the control of a scanning signal from the scanning signal terminal, a data signal from the data signal terminal, and a light-emitting control signal from the light-emitting control signal terminal; and an electrostatic discharge sub-circuit, coupled to a second voltage signal terminal and the first terminal of the light-emitting element, and configured to be able to conduct static electricity to the second voltage signal terminal in response to the static electricity generated at the first terminal of the light-emitting element.

20 Claims, 12 Drawing Sheets

(51) Int. Cl.
*G09G 3/3266* (2016.01)
*G09G 3/3291* (2016.01)

(58) Field of Classification Search
CPC ..... G09G 2330/025; G09G 2330/06; G09G 2330/08; G09G 2330/0852
See application file for complete search history.

(56) References Cited

U.S. PATENT DOCUMENTS

| | | | | |
|---|---|---|---|---|
| 9,640,097 | B2 | 5/2017 | Cai | |
| 10,714,010 | B2 | 7/2020 | Liu et al. | |
| 10,854,141 | B2 * | 12/2020 | Zhai | G09G 3/3233 |
| 2004/0004589 | A1 * | 1/2004 | Shih | G09G 3/3233 345/82 |
| 2004/0012545 | A1 * | 1/2004 | Li | G09G 3/3233 345/55 |
| 2006/0145951 | A1 * | 7/2006 | Watanabe | G02F 1/136204 345/55 |
| 2007/0001205 | A1 * | 1/2007 | Kimura | H01L 27/1255 257/296 |
| 2008/0158745 | A1 * | 7/2008 | Chen | G09G 3/3688 361/56 |
| 2014/0185169 | A1 | 7/2014 | Jung et al. | |
| 2015/0092128 | A1 * | 4/2015 | Lee | G02F 1/13452 349/40 |
| 2015/0379927 | A1 | 12/2015 | Cai | |
| 2016/0035276 | A1 | 2/2016 | Mn et al. | |
| 2017/0039936 | A1 | 2/2017 | Byun et al. | |
| 2019/0130836 | A1 * | 5/2019 | Liu | G09G 3/3233 |

FOREIGN PATENT DOCUMENTS

| | | | |
|---|---|---|---|
| CN | 103913865 | A | 7/2014 |
| CN | 104112426 | A | 10/2014 |
| CN | 106935197 | A | 7/2017 |

* cited by examiner

PIXEL DRIVING CIRCUIT AND DRIVING METHOD THEREOF, DISPLAY PANEL AND DISPLAY DEVICE

CROSS-REFERENCE TO RELATED APPLICATION(S)

This application claims priority to Chinese Application No. 201911111274.7, entitled "PIXEL DRIVING CIRCUIT AND DRIVING METHOD THEREOF, DISPLAY PANEL AND DISPLAY DEVICE" and filed on Nov. 13, 2019, which is incorporated herein by reference in its entirety.

TECHNICAL FIELD

The present disclosure relates to the field of display technologies, and in particular, to a pixel driving circuit and a driving method thereof, a display panel and a display device.

BACKGROUND

In recent years, with the rapid development of display technologies, the thin-film transistor (TFT) technology has developed from the previous amorphous-silicon (a-Si) thin-film transistors to the current low-temperature polysilicon (LTPS) thin-film transistors, metal-induced lateral crystallization (MILC) thin-film transistors, oxide thin-film transistors, etc., and the light-emitting technology has also developed from the previous liquid crystal display (LCD), plasma display panel (PDP) to the current organic light-emitting diode (OLED) display.

An OLED is a new generation of display devices. Compared with the liquid crystal display, the OLED has many advantages, such as self-luminous, fast response speed, wide viewing angle, and so on. The OLED may be used for flexible display, transparent display, 3D display, etc. An active-matrix organic light-emitting display (AMOLED) is equipped with a switch, such as a thin-film transistor, for controlling each pixel. Therefore, each pixel may be controlled by the driving circuit independently without affecting other pixels by, for example, crosstalk. Currently, new OLED displays are attracting more and more attention.

SUMMARY

According to a first aspect, an embodiment of the present disclosure provides a pixel driving circuit. The pixel driving circuit includes: a driving sub-circuit, coupled to a scanning signal terminal, a data signal terminal, a light-emitting control signal terminal, a first voltage signal terminal, and a first terminal of a light-emitting element, and configured to be able to output a first voltage signal from the first voltage signal terminal to the light-emitting element under the control of a scanning signal from the scanning signal terminal, a data signal from the data signal terminal, and a light-emitting control signal from the light-emitting control signal terminal; and an electrostatic discharge sub-circuit, coupled to a second voltage signal terminal and the first terminal of the light-emitting element, and configured to be able to conduct static electricity to the second voltage signal terminal in response to the static electricity generated at the first terminal of the light-emitting element.

In some embodiments, the electrostatic discharge sub-circuit includes: a first transistor, having a control terminal and a first terminal coupled to the first terminal of the light-emitting element, and a second terminal coupled to the second voltage signal terminal.

In some embodiments, the electrostatic discharge sub-circuit further includes: a second transistor, having a control terminal and a first terminal coupled to the second voltage signal terminal, and a second terminal coupled to the first terminal of the light-emitting element.

In some embodiments, the driving sub-circuit is further coupled to a reset signal terminal and the second voltage signal terminal, and configured to be able to output a second voltage signal from the second voltage signal terminal to the light-emitting element under the control of a reset signal from the reset signal terminal.

In some embodiments, the driving sub-circuit includes: a third transistor, having a control terminal coupled to the scanning signal terminal, a first terminal coupled to the data signal terminal, and a second terminal coupled to a control terminal of a fourth transistor; the fourth transistor, having the control terminal coupled to the second terminal of the third transistor, a first terminal coupled to a second terminal of a fifth transistor, and a second terminal coupled to a first terminal of a sixth transistor; the fifth transistor, having a control terminal coupled to the light-emitting control signal terminal, a first terminal coupled to the first voltage signal terminal, and the second terminal coupled to the first terminal of the fourth transistor; the sixth transistor, having a control terminal coupled to the light-emitting control signal terminal, the first terminal coupled to the second terminal of the fourth transistor, and a second terminal coupled to the first terminal of the light-emitting element; and a first capacitor, having a first terminal coupled to the second terminal of the third transistor, and a second terminal coupled to the first voltage signal terminal.

In some embodiments, the driving sub-circuit includes: a third transistor, having a control terminal coupled to the scanning signal terminal, a first terminal coupled to the data signal terminal, and a second terminal coupled to a first terminal of a first capacitor; a fourth transistor, having a control terminal coupled to a second terminal of the first capacitor, a first terminal coupled to the first voltage signal terminal, and a second terminal coupled to a first terminal of a sixth transistor; a fifth transistor, having a control terminal coupled to the light-emitting control signal terminal, a first terminal coupled to the first voltage signal terminal, and a second terminal coupled to the first terminal of the first capacitor; the sixth transistor, having a control terminal coupled to the light-emitting control signal terminal, the first terminal coupled to the second terminal of the fourth transistor, and a second terminal coupled to the first terminal of the light-emitting element; an eighth transistor, having a control terminal coupled to the scanning signal terminal, a first terminal coupled to the second terminal of the first capacitor, and a second terminal coupled to the first terminal of the sixth transistor; and the first capacitor, having the first terminal coupled to the second terminal of the third transistor, and the second terminal coupled to the first terminal of the eighth transistor.

In some embodiments, the driving sub-circuit further includes: a seventh transistor, having a control terminal coupled to the reset signal terminal, a first terminal coupled to the second voltage signal terminal, and a second terminal coupled to the first terminal of the light-emitting element.

In some embodiments, the driving sub-circuit includes: a third transistor, having a control terminal coupled to the scanning signal terminal, a first terminal coupled to the data signal terminal, and a second terminal coupled to a first terminal of a fourth transistor; the fourth transistor, having a control terminal coupled to a first terminal of a first capacitor, the first terminal coupled to a second terminal of a fifth transistor, and a second terminal coupled to a first terminal of a sixth transistor; the fifth transistor, having a control terminal coupled to the light-emitting control signal terminal, a first terminal coupled to the first voltage signal terminal, and the second terminal coupled to the first terminal of the fourth transistor; the sixth transistor, having a control terminal coupled to the light-emitting control signal terminal, the first terminal coupled to the second terminal of the fourth transistor, and a second terminal coupled to the first terminal of the light-emitting element; an eighth transistor, having a control terminal coupled to the scanning signal terminal, a first terminal coupled to the first terminal of the first capacitor, and a second terminal coupled to the first terminal of the sixth transistor; and the first capacitor, having the first terminal coupled to the control terminal of the fourth transistor, and the second terminal coupled to the first voltage signal terminal.

In some embodiments, the driving sub-circuit further includes: a seventh transistor, having a control terminal coupled to the reset signal terminal, a first terminal coupled to the second voltage signal terminal, and a second terminal coupled to the first terminal of the light-emitting element; and a ninth transistor, having a control terminal coupled to the reset signal terminal, a first terminal coupled to the second voltage signal terminal, and a second terminal coupled to the first terminal of the first capacitor.

In some embodiments, each transistor in the pixel driving circuit is an N-type transistor, the first voltage signal from the first voltage signal terminal is a high-level signal, and the second voltage signal from the second voltage signal terminal is a low-level signal.

In some embodiments, an aspect ratio of a channel of each of the first transistor and the second transistor is less than one.

In some embodiments, an aspect ratio of a channel of each of the first transistor and the second transistor is 3/6.

In another aspect, a display panel is provided, including the pixel driving circuit as described above and the light-emitting element.

In some embodiments, the display panel further includes: a low-level voltage signal terminal of a mesh structure for providing a low level and being coupled to a cathode of the light-emitting element.

In some embodiments, the display panel further includes: an electrostatic circuit coupled to the low-level signal terminal and the second voltage signal terminal, wherein the electrostatic circuit includes unidirectional elements connected in parallel and reversely.

In yet another aspect, a display device is provided, including the display panel as described above and a rear panel.

In yet another aspect, a method for driving a pixel driving circuit as described above is provided. Within a period of one frame, the method includes: during a reset stage, inputting an inactive-level scanning signal at the scanning signal terminal; inputting a data signal at the data signal terminal; inputting an active-level reset signal at a reset signal terminal; inputting an inactive-level light-emitting control signal at the light-emitting control signal terminal; inputting a first voltage signal of a high level at the first voltage signal terminal; inputting a second voltage signal of a low level at the second voltage signal terminal; and outputting an inactive-level driving signal to the light-emitting element by the pixel driving circuit; during a signal-writing stage, inputting an active-level scanning signal at the scanning signal terminal; inputting a data signal at the data signal terminal; inputting an inactive-level reset signal at a reset signal terminal; inputting an inactive-level light-emitting control signal at the light-emitting control signal terminal; inputting the first voltage signal of a high level at the first voltage signal terminal; inputting the second voltage signal of a low level at the second voltage signal terminal, and outputting an inactive-level driving signal to the light-emitting element by the pixel driving circuit; and during a light-emitting stage, inputting an inactive-level scanning signal at the scanning signal terminal; inputting a data signal at the data signal terminal; inputting an inactive-level reset signal at the reset signal terminal; inputting an active-level light-emitting control signal at the light-emitting control signal terminal; inputting the first voltage signal of a high level at the first voltage signal terminal; inputting the second voltage signal of a low level at the second voltage signal terminal; and outputting a driving signal corresponding to the data signal input during the signal-writing stage to the light-emitting element by the pixel driving circuit, for driving the light-emitting element to emit light at a corresponding gray scale.

In some embodiments, the method further includes: conducting static electricity out of the second voltage signal terminal by the electrostatic discharge sub-circuit of the pixel driving circuit in response to the static electricity generated between the light-emitting element and the pixel driving circuit.

In some embodiments, the method further includes: conducting static electricity of another pixel driving circuit out of the pixel driving circuit to the light-emitting element in response to the static electricity received at the second voltage signal terminal.

BRIEF DESCRIPTION OF THE DRAWINGS

The above and/or additional objects, features and advantages of the present disclosure will become apparent and easily understood from the following description of the embodiments in conjunction with the accompanying drawings, in which.

DETAILED DESCRIPTION

Figure 1:
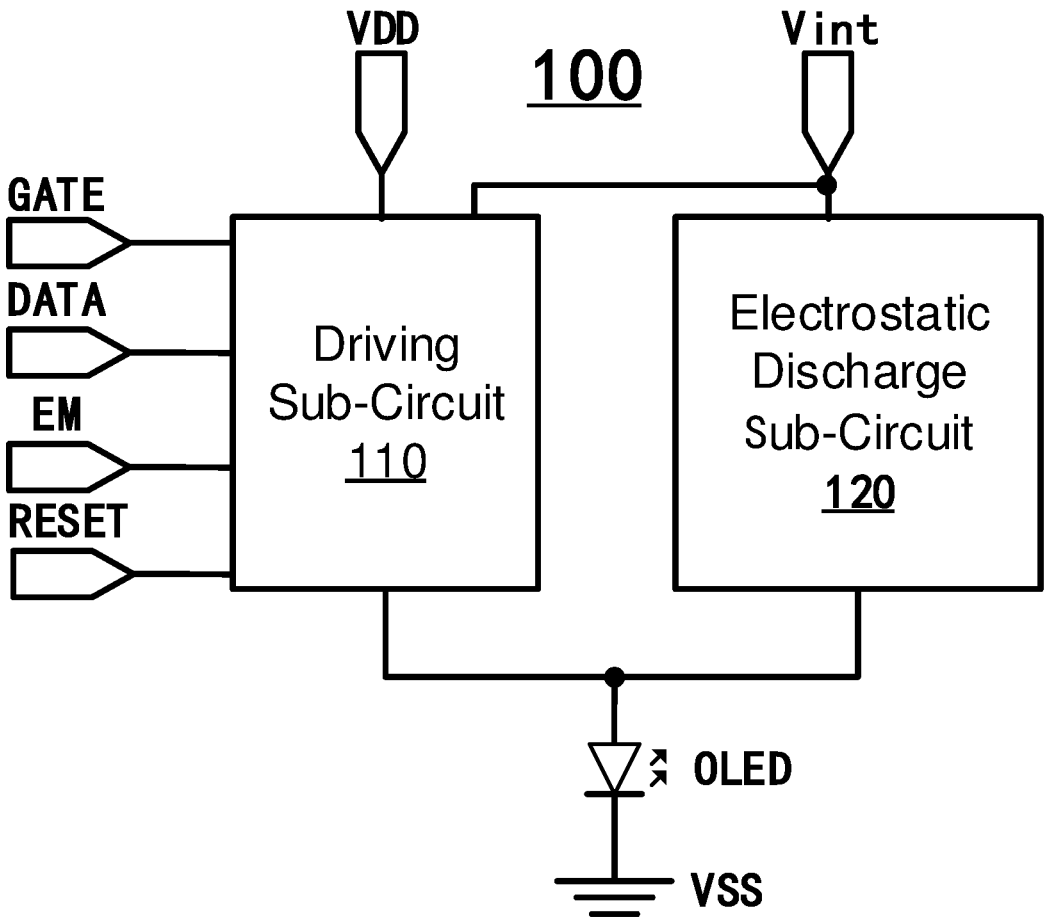
FIG. 1 is a schematic diagram illustrating an exemplary structure of a pixel driving circuit according to an embodiment of the present disclosure.

Hereinafter, some embodiments of the present disclosure will be described in detail with reference to the accompanying drawings. Details and functions that are unnecessary for the present disclosure are omitted in the describing process to prevent confusion in the understanding of the present disclosure. In this specification, various embodiments described below for describing the principles of the present disclosure are merely illustrative but should not be construed as limiting the scope of the present disclosure in any way. The following description made with reference to the accompanying drawings is provided to assist in comprehensive understanding of exemplary embodiments of the present disclosure as defined by the claims and their equivalents. The following description includes various specific details to assist the understanding, but these details should be considered as merely exemplary. Accordingly, those skilled in the art should recognize that various changes and modifications can be made to the embodiments described herein without departing from the scope and spirit of the present disclosure. In addition, descriptions of well-known functions and constructions are omitted for clarity and conciseness. In addition, throughout the drawings, the same reference numerals are used for the same or similar functions, devices, and/or operations. Moreover, in the drawings, various parts are not necessarily drawn to scale. In other words, the relative sizes, lengths, etc. of the parts in the drawings do not necessarily correspond to the actual proportions.

In the present disclosure, the terms "comprising", "including" and "containing" and their derivatives mean to be inclusive but not limiting; the term "or" is inclusive, meaning "and/or". In addition, in the following description of the present disclosure, azimuth terms such as "up", "down", "left", "right" and the like are used to indicate relative position relationships to assist those skilled in the art to understand the embodiments of the present disclosure, and therefore those skilled in the art should understand that "up"/"down" in one direction may become "down"/"up" in the opposite direction, and may become other location relationship, such as "left"/"right", in another direction.

Hereinafter, a pixel driving circuit in an embodiment of the present disclosure that is applied to an OLED display device will be described as an example for detailed description. However, those skilled in the art should understand that the field in which the present disclosure is applied is not limited thereto. In addition, although the transistors hereinafter are described as N-type transistors as an example, the present disclosure is not limited thereto. In fact, as can be understood by those skilled in the art, the technical solution of the present disclosure may also be implemented when one or more of the various transistors described hereinafter are P-type transistors, except that the level setting/coupling relationships need to be adjusted accordingly.

OLED displays also have their own disadvantages. For example, there is a problem of a weak antistatic ability during a manufacturing process of an OLED driving rear panel. Electrostatic discharge (ESD) may occur during actual production, testing, and/or transportation processes. After the static electricity is introduced into the pixel driving circuit by an anode electrode of the OLED element, the nearest TFT, such as a TFT for resetting, is usually damaged. Therefore, in the case of ESD, the elements may be damaged, and thus the products may be defective.

In order to solve or at least partially alleviate the above problems, a pixel driving circuit and a driving method thereof according to embodiments of the present disclosure, and a display panel and a display device including the pixel driving circuit are provided.

In general, it is possible to reduce the damage caused by the static electricity in a single pixel by setting a sub-circuit for discharging the static electricity to other pixel(s), thereby improving the anti-static ability of the pixel driving circuit and even the anti-static ability of the display panel and display device, and thus improving the reliability and the product yield of the OLED. More specifically, in some embodiments, e.g. an electrostatic discharge electronic circuit, such as a first transistor and/or a second transistor as described below, may be provided in each pixel driving circuit, so that the static electricity may be discharged to other pixel(s) through the first transistor, and/or the static electricity generated in other pixel(s) may be shared by the second transistor, thereby avoiding device damage caused by the ESD.

Hereinafter, a structure and an operation principle of an exemplary pixel driving circuit according to an embodiment of the present disclosure will be described with reference to FIGS. 1 to 5C.

FIG. 1 is a schematic diagram illustrating an exemplary structure of a pixel driving circuit 100 according to an embodiment of the present disclosure. As shown in FIG. 1, the pixel driving circuit 100 may include a driving sub-circuit 110 and an electrostatic discharge sub-circuit 120. In some embodiments, the driving sub-circuit 110 may be coupled to a scanning signal terminal GATE, a data signal terminal DATA, a light-emitting control signal terminal EM, a first voltage signal terminal VDD, and a first terminal of a light-emitting element OLED (for example, an anode of the OLED), and configured to be able to output a first voltage signal from the first voltage signal terminal VDD to the light-emitting element under the control of a scanning signal from the scanning signal terminal GATE, a data signal from the data signal terminal DATA, and a light-emitting control signal from the light-emitting control signal terminal EM. In addition, in some embodiments, the electrostatic discharge sub-circuit 120 may be coupled to a second voltage signal terminal Vint and the first terminal of the light-emitting element OLED, and configured to be able to conduct static electricity to the second voltage signal terminal Vint in response to the static electricity generated at the first terminal of the light-emitting element OLED.

With such a structure, when static electricity is generated at, e.g., the anode of the light-emitting element OLED, the static electricity may be conducted to the second voltage signal terminal Vint by the electrostatic discharge sub-circuit 120, and then dispersed to other pixel driving circuit(s), thereby avoiding damage to a single pixel driving circuit due to greater electrostatic discharge to the pixel driving circuit.

In some embodiments, as shown in FIG. 1, the driving sub-circuit 110 is further coupled to a reset signal terminal RESET and the second voltage signal terminal Vint, and configured to be able to output a second voltage signal from the second voltage signal terminal to the light-emitting element OLED under the control of a reset signal from the reset signal terminal RESET.

Figure 2:
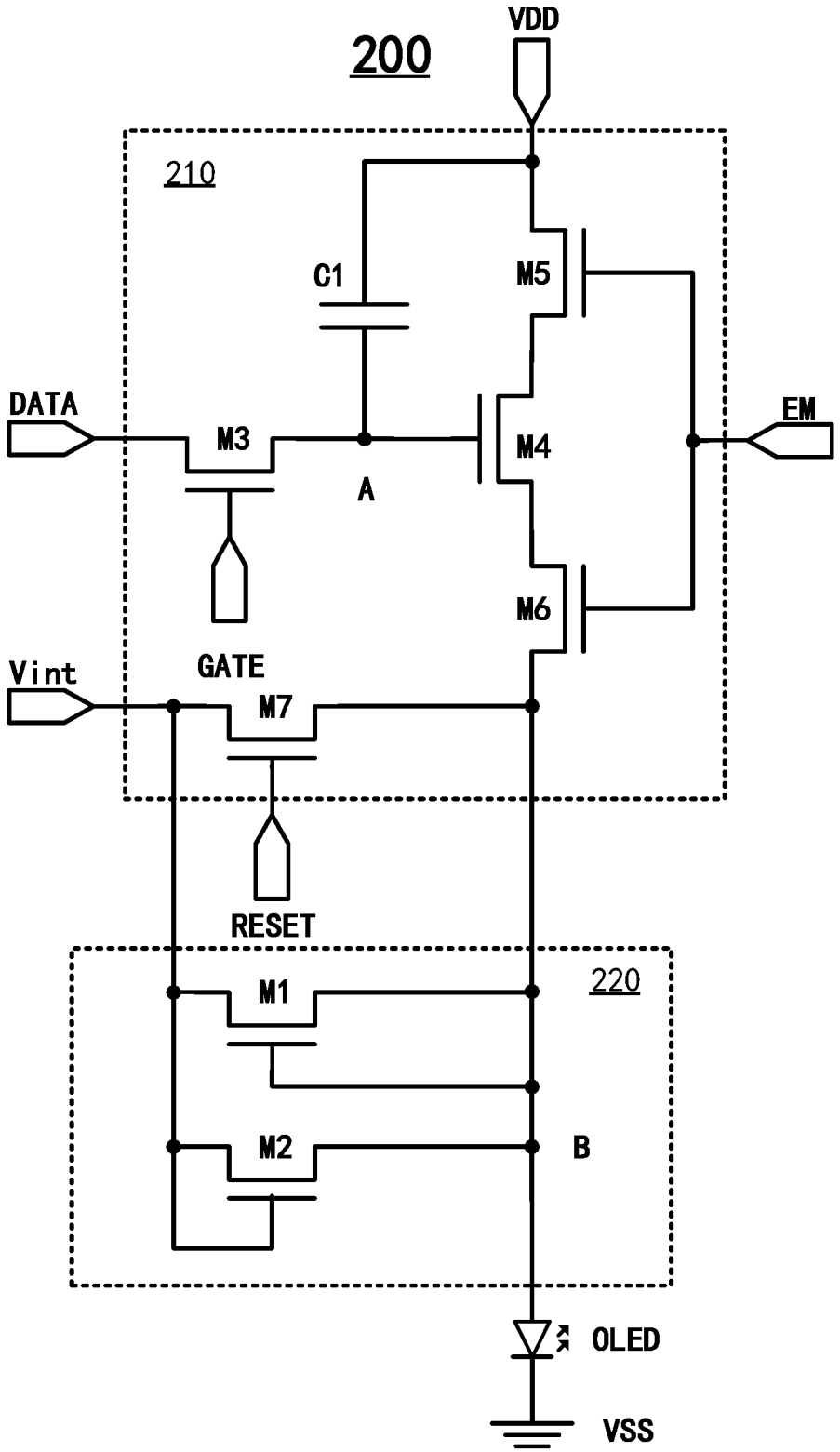
FIG. 2 is a schematic diagram illustrating an exemplary specific structure of the pixel driving circuit as shown in FIG. 1.

FIG. 2 is a schematic diagram illustrating an exemplary specific structure 200 of the pixel driving circuit 100 as shown in FIG. 1. As shown in FIG. 2, the pixel driving circuit 200 may include a driving sub-circuit 210 and an electrostatic discharge sub-circuit 220.

As shown in FIG. 2, the electrostatic discharge sub-circuit 220 may include a first transistor M1 and a second transistor M2. In some embodiments, a control terminal and a first terminal of the first transistor M1 may be coupled to the first terminal of the light-emitting element OLED, and a second terminal of the first transistor M1 may be coupled to the second voltage signal terminal Vint. In some embodiments, a control terminal and a first terminal of the second transistor M2 may be coupled to the second voltage signal terminal Vint, and a second terminal of the second transistor M2 may be coupled to the first terminal of the light-emitting element OLED.

With such an arrangement, when the static electricity is generated at or introduced to, e.g., Node B (e.g., the anode of the OLED) as shown in FIG. 2, the static electricity may be conducted to the second voltage signal terminal Vint through the first transistor M1, and may further be conducted to other pixel(s) via a network constructed by lines Vint and to the anode of the OLED element through the second transistor(s) M2 provided in other pixel driving circuit(s), so as to avoid greater electrostatic discharge generated in a single pixel, thereby protecting the pixel driving circuit 200.

In addition, as shown in FIG. 2, the driving sub-circuit 210 may use a structure of 5T1C (5 transistors and 1 capacitor). Specifically, the driving sub-circuit 210 may include a third transistor M3 to a seventh transistor M7. In some embodiments, a control terminal of the third transistor M3 may be coupled to the scanning signal terminal GATE, a first terminal of the third transistor M3 may be coupled to the data signal terminal DATA, and a second terminal of the third transistor M3 may be coupled to a control terminal of the fourth transistor M4. In some embodiments, a control terminal of the fourth transistor M4 may be coupled to the second terminal of the third transistor M3, a first terminal of the fourth transistor M4 may be coupled to a second terminal of the fifth transistor M5, and a second terminal of the fourth transistor M4 may be coupled to a first terminal of the sixth transistor M6. In some embodiments, a control terminal of the fifth transistor M5 may be coupled to the light-emitting control signal terminal EM, a first terminal of the fifth transistor M5 may be coupled to the first voltage signal terminal VDD, and the second terminal of the fifth transistor M5 may be coupled to the first terminal of the fourth transistor M4. In some embodiments, a control terminal of the sixth transistor M6 may be coupled to the light-emitting control signal terminal EM, the first terminal of the sixth transistor M6 may be coupled to the second terminal of the fourth transistor M4, and a second terminal of the sixth transistor M6 may be coupled to the first terminal of the light-emitting element OLED. In some embodiments, a first terminal of the first capacitor C1 may be coupled to the second terminal of the third transistor M3, and a second terminal of the first capacitor C1 may be coupled to the first voltage signal terminal VDD. In addition, in some embodiments, a control terminal of the seventh transistor M7 may be coupled to the reset signal terminal RESET, a first terminal of the seventh transistor M7 may be coupled to the second voltage signal terminal Vint, and a second terminal of the seventh transistor M7 may be coupled to the first terminal of the light-emitting element OLED. Hereinafter, the work flow of the pixel driving circuit 200 will be described in more detail with reference to FIGS. 2 and 4.

Figure 3:
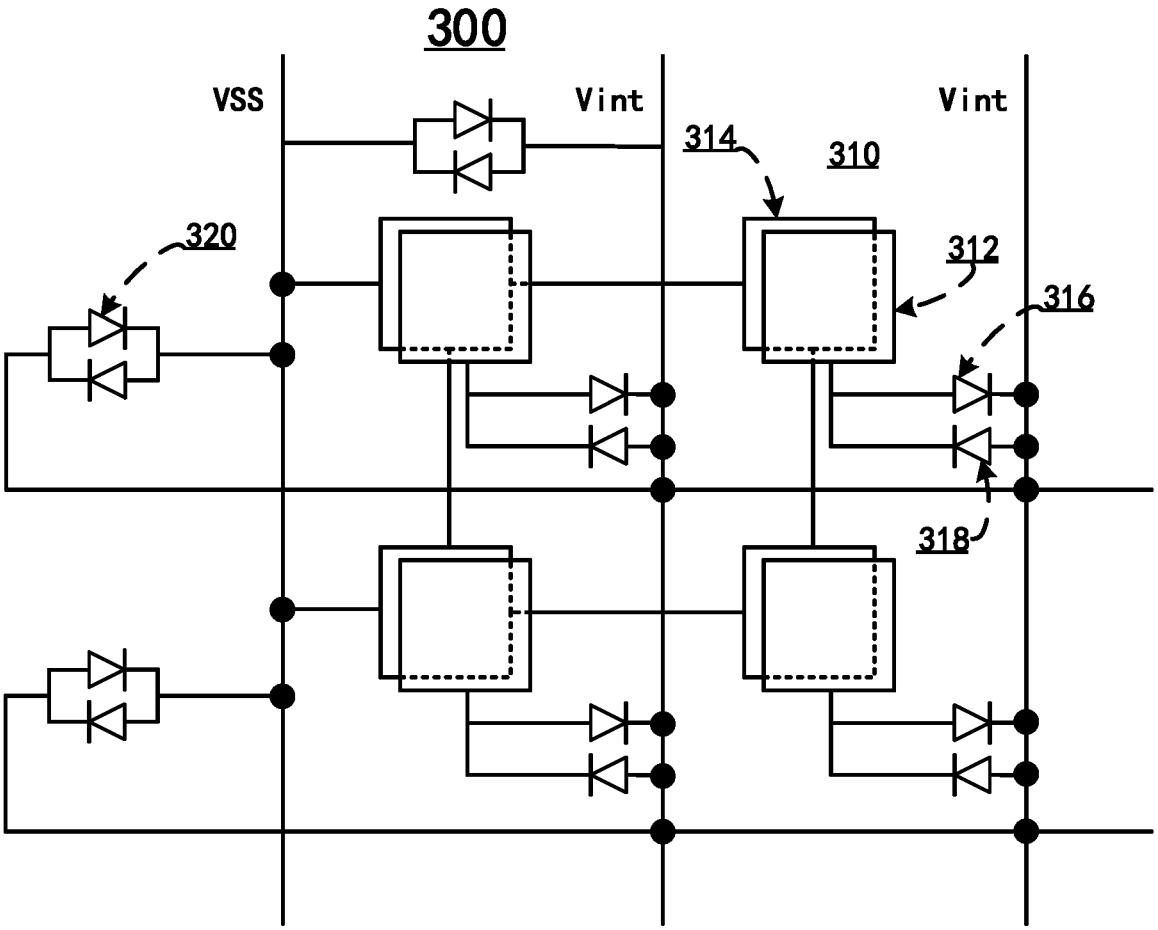
FIG. 3 is a schematic diagram illustrating electrical connection relationships between a plurality of pixels according to an embodiment of the present disclosure.

FIG. 3 is a schematic diagram illustrating electrical connection relationships between a plurality of pixels 310 according to an embodiment of the present disclosure. As shown in FIG. 3, the display panel 300 may include a plurality of pixels 310. In at least one pixel 310, a pixel electrode 312 and a common electrode 314 may be provided. As shown schematically in FIG. 3, the corresponding pixel electrode 312 and common electrode 314 may overlap with each other so that a potential difference is formed between them during the operation, which causes the OLED element between them to work normally and emit light. However, it should be noted that the positional relationship between the pixel electrode 312 and the common electrode 314 is not limited to the overlapping relationship as shown in FIG. 3, but may have any appropriate positional relationship as required.

In addition, in the embodiments as shown in FIG. 2 and FIG. 3, the pixel electrode 312 of the pixel 310 may be the anode of the OLED element or electrically connected thereto, and the common electrode 314 may be the cathode of the OLED element or electrically connected thereto. However, the present disclosure is not limited thereto. In fact, the pixel electrode 312 of the pixel 310 may also be the cathode of the OLED element or electrically connected thereto, and the common electrode 314 may also be the anode of the OLED element or electrically connected thereto.

When, for example, the static electricity is generated at or introduced to the anode or pixel electrode 312 of the OLED (e.g., when a great amount of static electricity is accumulated at the anode 312 during production, testing, or transportation), the static electricity may be conducted to the Vint line through a unidirectional element 316 (e.g., the first transistor M1 as shown in FIG. 2) of the corresponding pixel 310, and dispersed to the anodes or pixel electrodes 312 of the OLEDs in other pixels through the network formed by the Vint lines and unidirectional elements 318 (e.g., the second transistor M2 as shown in FIG. 2) of other pixels 310, thereby avoiding damage to the element (e.g., breakdown of the seventh transistor M7 for reset as shown in FIG. 2, etc.) due to excessive static electricity in the single pixel 310.

In addition, as shown in FIG. 3, the cathodes or common electrodes 314 of the respective pixels 310 may be electrically connected to each other, and eventually all connected to peripheral VSS signal lines in a mesh structure. In addition, the VSS signal line and the Vint signal line are electrically connected through the electrostatic circuit 320, thereby further forming the electrostatic discharge circuit to avoid damage to a single pixel by a great amount of static electricity in the pixel. The electrostatic circuit 320 includes unidirectional elements that are connected in parallel and reversely. Although the unidirectional element is shown as a diode in FIG. 3, it is obvious that the first transistor or the second transistor that is connected in the same way as the diodes shown in FIG. 2 is also applicable.

With the pixel connection arrangement as shown in FIG. 3, when the voltage on the cathode or common electrode 314 of any pixel is too high, it may be transmitted to the peripheral electrostatic discharge circuit 320 through the VSS line, and then released to the Vint line, and further released to the anode or pixel electrode 312 of each pixel through, e.g., the unidirectional conduction element 318. In this way, the static electricity at the cathode or common electrode of each pixel may also be released to the respective pixels, thereby avoiding the damage to the corresponding pixel by a great amount of static electricity. Therefore, by adopting the above-mentioned antistatic design, the antistatic ability of the OLED rear panel, especially the antistatic ability during the subsequent evaporation and packaging processes, may be improved, thereby improving the product yield.

Next, the operation timing sequence of the pixel driving circuit according to the embodiment of the present disclosure will be described in detail with reference to FIGS. 4, 5A to 5C. The following description will use the N-type transistor in the pixel driving circuit as an example to explain in detail, that is, a high-level signal is a signal of an active level that makes each transistor in the pixel-driving circuit turned on; and a low-level signal is a signal of an inactive level that makes each transistor in the pixel-driving circuit turned off or switched off. However, it should be noted that when e.g. a P-type transistor is used in the pixel driving circuit, a high-level signal is a signal of an inactive level that makes each transistor in the pixel-driving circuit turned off or switched off, and a low-level signal is a signal of an active level that makes each transistor in the pixel-driving circuit turned on. Therefore, those skilled in the art may also implement a pixel driving circuit using the P-type transistor according to the embodiment of the present disclosure based on the following description.

Figure 4:
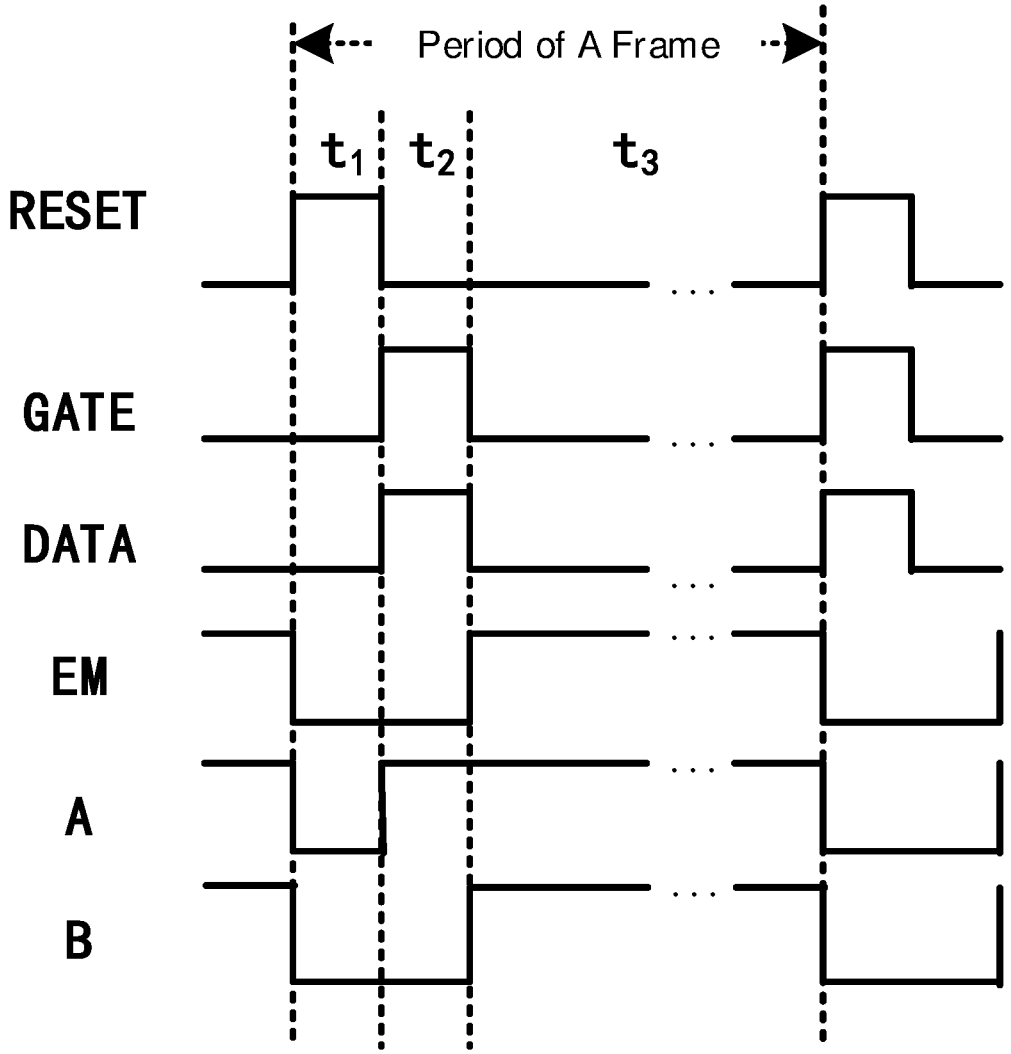
FIG. 4 is an exemplary operation timing sequence of the pixel driving circuit as shown in FIG. 2.

FIG. 4 is an exemplary operation timing sequence of the pixel driving circuit 200 as shown in FIG. 2, and FIGS. 5A to 5C are exemplary equivalent circuit diagrams of the pixel driving circuit 200 as shown in FIG. 2 at different stages $t_1$~$t_3$.

As shown in FIG. 4, during the first stage $t_1$ (reset stage), a low-level scanning signal may be input at the scanning signal terminal GATE; a data signal (any level is acceptable) may be input at the data signal terminal DATA; a high-level reset signal may be input at the reset signal terminal RESET; a low-level light-emitting control signal may be input at the light-emitting control signal terminal EM; a first voltage signal of a high level may be input at the first voltage signal terminal VDD; a second voltage signal of a low level may be input at the second voltage signal terminal Vint; and a low-level driving signal may be output to the corresponding Organic Light-Emitting Diode (OLED) element by the pixel driving circuit (e.g., the pixel driving circuit 200). At this time, since the level on the VSS line is also a low level, the potential difference between the two terminals of the OLED element is zero or close to zero, so that the OLED element does not emit light.

Figure 5A:
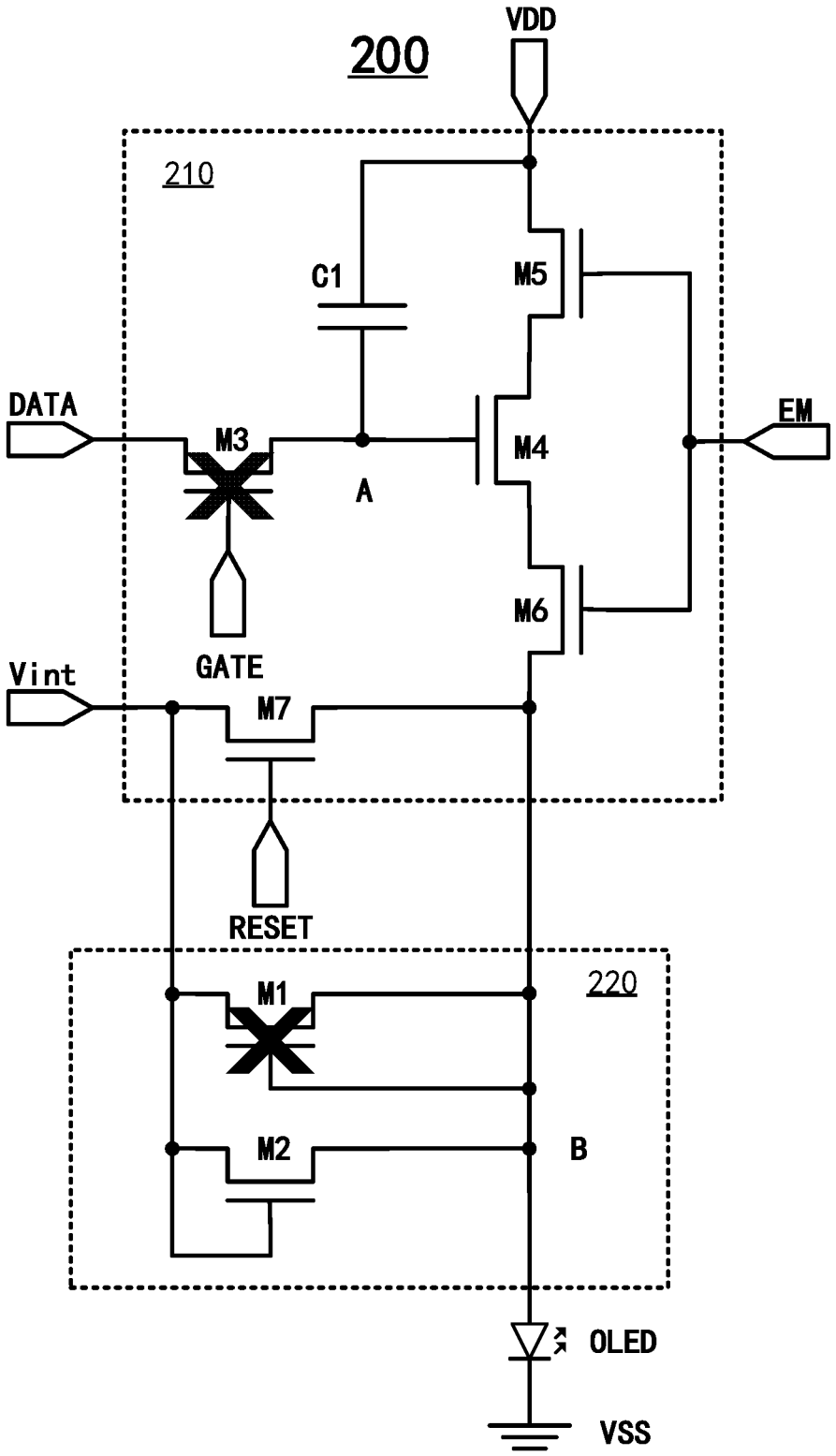
FIGS. 5A to 5C are exemplary equivalent circuit diagrams of the pixel driving circuit as shown in FIG. 2 at different stages.

Specifically, as shown in FIG. 5A, since the scanning signal from the scanning signal terminal GATE and the light-emitting control signal from the light-emitting control signal terminal EM are inactive signals of a low level, the third transistor M3, the fifth transistor M5, and the sixth transistor M6 are all turned off. At this time, regardless of whether the fourth transistor M4 is turned off or on, the operation of other parts of the pixel driving circuit is not affected since both the fifth transistor M5 and the sixth transistor M6 on both sides of the fourth transistor M4 are turned off. Thus, the fourth transistor M4 may also be regarded as being turned off. In addition, since the reset signal from the reset signal terminal RESET is an active signal of a high level, the seventh transistor M7 is turned on, so that the first terminal (e.g., the anode) of the OLED element is reset to an inactive signal of a low level from the second voltage signal terminal Vint. Therefore, the OLED element does not emit light, and both the first transistor M1 and the second transistor M2 are turned off.

As shown in FIG. 4, during the second stage $t_2$ (signal writing stage), a high-level scanning signal may be input at the scanning signal terminal GATE; a data signal (e.g., a data signal with a level corresponding to an expected gray scale of the pixel) may be input at the data signal terminal; a low-level reset signal may be input at the reset signal terminal RESET; a low-level light-emitting control signal may be input at the light-emitting control signal terminal EM; a first voltage signal of a high level may be input at the first voltage signal terminal VDD; a second voltage signal of a low level may be input at the second voltage signal terminal Vint, and a low-level driving signal may be output to the corresponding light-emitting element by the pixel driving circuit. At this time, since the level on the VSS line is also a low level, the potential difference between the two terminals of the OLED element is zero or close to zero, so that the OLED element does not emit light.

Figure 5B:
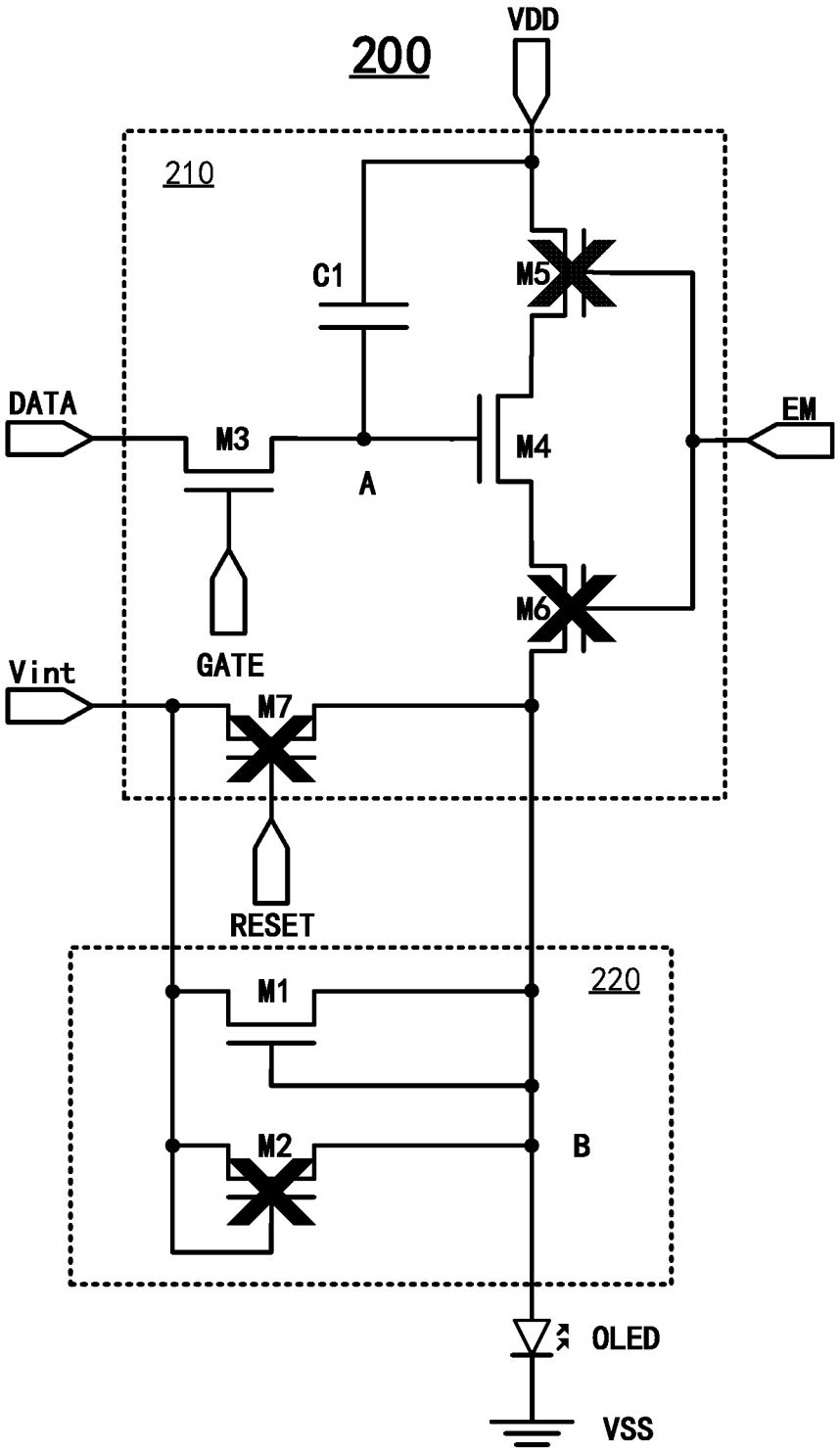

Specifically, as shown in FIG. 5B, since the reset signal from the reset signal terminal RESET and the light-emitting control signal from the light-emitting control signal terminal EM are inactive signals having low level, the seventh transistor M7, the fifth transistor M5, and the sixth The transistors M6 are all turned off. In addition, since the scanning signal from the scanning signal terminal GATE is an active signal of a high level, the third transistor M3 is turned on, thereby transmitting the data signal from the data signal terminal DATA to Node A, which is further stored in the first capacitor C1, and makes the fourth transistor M4 turned on. However, since the fifth transistor M5 and the sixth transistor M6 on both sides of the fourth transistor M4 are turned off, the high-level state of the previous stage is stilled maintained at Node B. At this time, the OLED element does not emit light, and both the first transistor M1 and the second transistor M2 are turned off.

As shown in FIG. 4, during the third stage $t_3$ (light-emitting stage), a low-level scanning signal may be input at the scanning signal terminal GATE, a data signal (any level is acceptable) may be input at the data signal terminal DATA; a low-level reset signal may be input at the reset signal terminal RESET; a high-level light-emitting control signal may be input at the light-emitting control signal terminal EM; a first voltage signal of a high level may be input at the first voltage signal terminal VDD; a second voltage signal of a low level may be input at the second voltage signal terminal Vint; and a driving signal corresponding to the data signal input during the signal-writing stage may be output to the light-emitting element by the pixel driving circuit, for driving the light-emitting element to emit light at the corresponding gray scale.

Figure 5C:
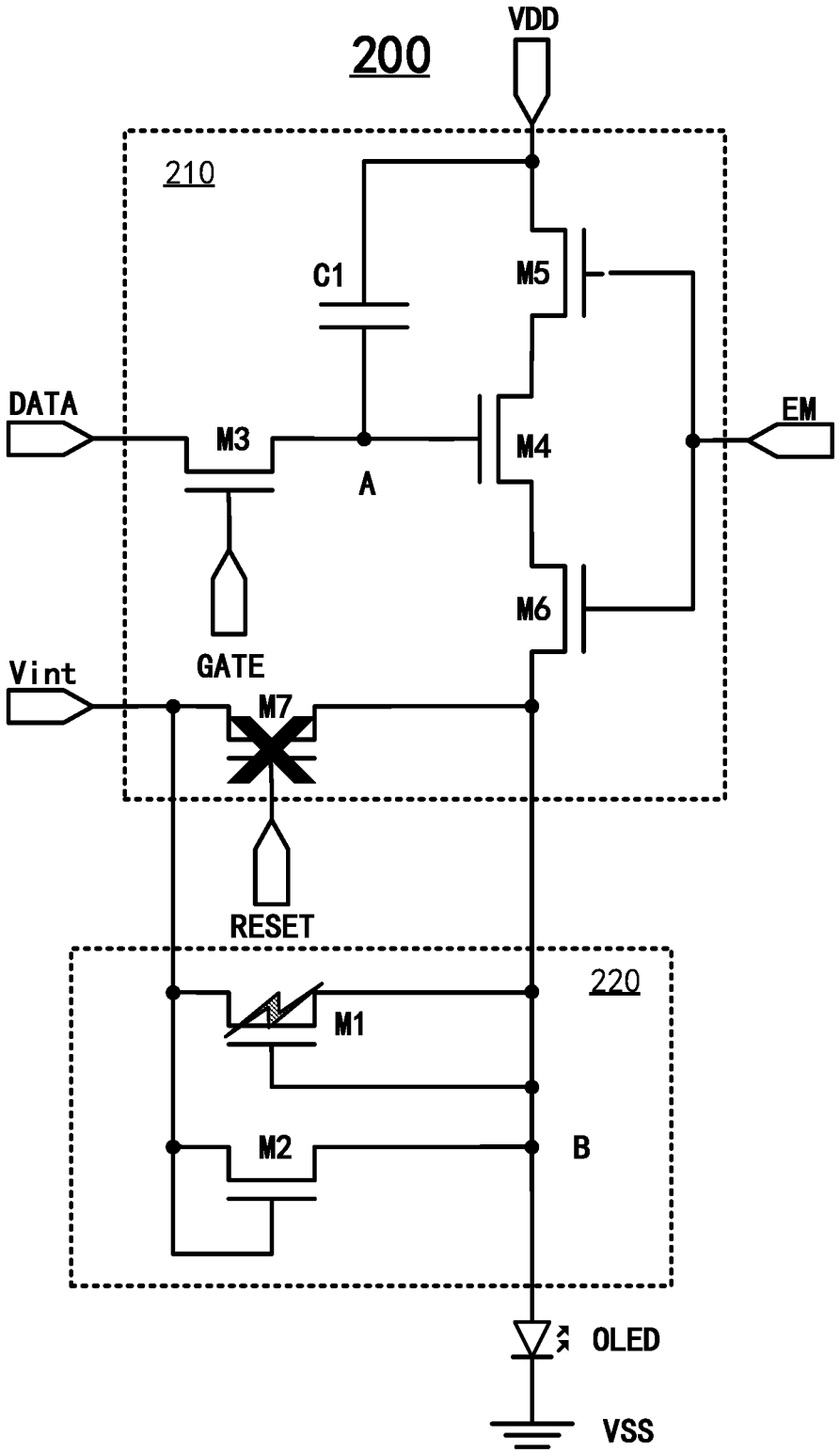

Specifically, as shown in FIG. 5C, since the reset signal from the reset signal terminal RESET and the scanning signal from the scanning signal terminal GATE are inactive signals of a low level, the seventh transistor M7 and the third transistor M3 are both turned off. In addition, since the light-emitting control signal from the light-emitting control signal terminal EM is an active signal of a high level, the fifth transistor M5 and the sixth transistor M6 are turned on. At the same time, since the first capacitor C1 is in a floating state at one side, i.e., the side at Node A, and its second terminal is coupled to the first voltage signal terminal VDD having a high-level signal, it maintains the level of Node A, thereby keeping the fourth transistor M4 being turned on. Therefore, the turn-on of the fifth transistor M5, the fourth transistor M4, and the sixth transistor M6 makes the first voltage signal of a high level from the first voltage signal terminal VDD conducted to Node B, which then drives the OLED element to emit light, until a period of one frame ends. Next, the operation period of the next frame may be started, which is similar to that described previously.

At this time, compared with the high voltage when the static electricity is generated, the driving voltage for driving the OLED element to emit light is lower, and therefore the first transistor M1 has only a slight electric leakage, which does not substantially affect the normal operation of the pixel driving circuit. In addition, the influence of the aspect ratio of the first transistor M1 on the electric leakage will be discussed below with reference to FIG. 8 and an attempt to solve or at least alleviate the problem will be made. In addition, the second transistor M2 is also turned off under the control of the second voltage signal of the second voltage signal terminal Vint of a low level.

It should be noted that the operation timing sequence as shown in FIG. 4 is only an embodiment for illustration, and it may be different from the actual operation timing sequence. For example, in some embodiments, each input/output voltage signal may not be a square wave as shown in FIG. 4, but a waveform with slight jitter, continuous decline or continuous rise over time, or a rising edge/falling edge of a pulse is not as vertical as shown in FIG. 4 but with a certain slope change, or the signals from different signal terminals are not necessarily strictly synchronized, but these do not affect the normal operation of the pixel driving circuit 200.

In addition, at any stage, when the static electricity occurs between the OLED element and the pixel driving circuit 200, the electrostatic discharge sub-circuit 220 (e.g., the second transistor M2) of the pixel driving circuit 200 may conduct the static electricity out of the second voltage signal terminal Vint. Specifically, when the static electricity occurs at, e.g., Node B, the static electricity will make the first transistor M1 turned on instantly, and is conducted to the Vint network as shown in FIG. 3 through the second voltage signal terminal Vint, and is further dispersed to other pixel driving circuit(s) through the electrostatic discharge sub-circuit(s) 220 (e.g., the first transistor(s) M1) provided in the other pixel driving circuit(s). Therefore, the damage to the single pixel driving circuit 200 by the static electricity may be avoided.

In addition, although the N-type transistor is used as an example in the above embodiments, the present disclosure is not limited thereto. In other embodiments, P-type transistors may also be used.

In addition, it should be noted that the pixel driving circuit 200 as shown in FIG. 2 is only one possible way to implement the pixel driving circuit 100 as shown in FIG. 1, and the present disclosure is not limited thereto. For example, some other specific implementations of the pixel driving circuit 100 are described below with reference to FIGS. 6 and 7. In fact, for any circuit capable of realizing the pixel driving function, the electrostatic protection function of the pixel driving circuit may be realized by merely adding an electrostatic discharge sub-circuit correspondingly.

Figure 6:
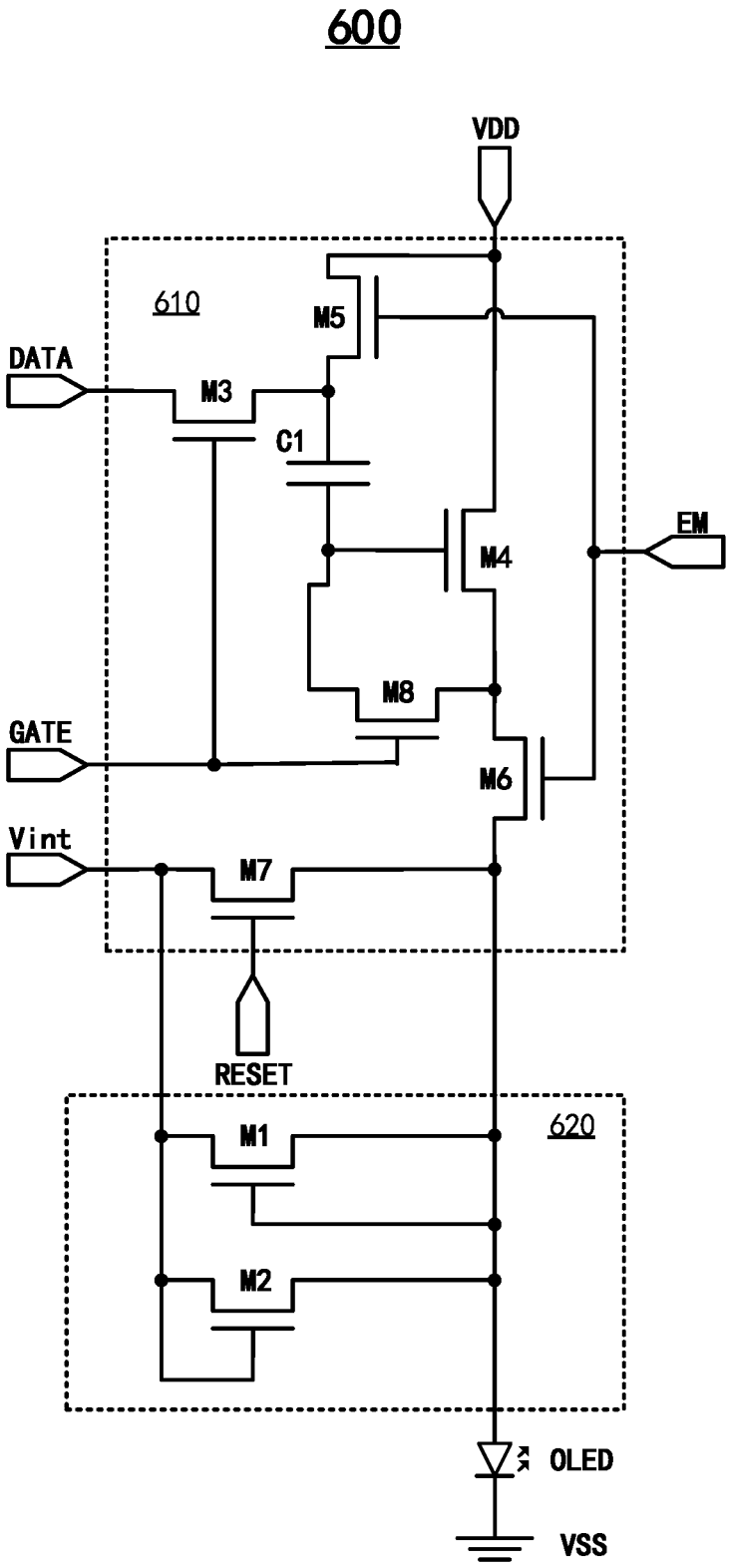
FIG. 6 is a schematic diagram illustrating another exemplary specific structure of the pixel driving circuit as shown in FIG. 1.

Next, a structure of an exemplary pixel driving circuit according to another embodiment of the present disclosure will be described with reference to FIG. 6. FIG. 6 is a schematic diagram showing another exemplary specific structure 600 of the pixel driving circuit 100 as shown in FIG. 1. Compared with the pixel driving circuit 200 as shown in FIG. 2, the pixel driving circuit 600 of FIG. 6 uses an 8T1C configuration, in which the electrostatic discharge sub-circuit 620 is substantially the same as the electrostatic discharge sub-circuit 220, but the driving sub-circuit 610 is different from the driving sub-circuit 210. For brevity and clarity, only the differences between the pixel driving circuit 600 and the pixel driving circuit 200 will be described below.

As shown in FIG. 6, the driving sub-circuit 610 may include a third transistor M3 to an eighth transistor M8. In some embodiments, a control terminal of the third transistor M3 may be coupled to the scanning signal terminal GATE, a first terminal of the third transistor M3 may be coupled to the data signal terminal DATA, and a second terminal of the third transistor M3 may be coupled to a first terminal of a first capacitor C1. In some embodiments, a control terminal of the fourth transistor M4 may be coupled to a second terminal of the first capacitor C1, a first terminal of the fourth transistor M4 may be coupled to the first voltage signal terminal VDD, and a second terminal of the fourth transistor M4 may be coupled to a first terminal of the sixth transistor M6. In some embodiments, a control terminal of the fifth transistor M5 may be coupled to the light-emitting control signal terminal EM, a first terminal of the fifth transistor M5 may be coupled to the first voltage signal terminal VDD, and a second terminal of the fifth transistor M5 may be coupled to the first terminal of the first capacitor C1. In some embodiments, a control terminal of the sixth transistor M6 may be coupled to the light-emitting control signal terminal EM, the first terminal of the sixth transistor M6 may be coupled to the second terminal of the fourth transistor M4, and the second terminal of the sixth transistor M6 may be coupled to the first terminal of the light-emitting element OLED. In some embodiments, a control terminal of the eighth transistor M8 may be coupled to the scanning signal terminal GATE, a first terminal of the eighth transistor M8 may be coupled to the second terminal of the first capacitor C1, and a second terminal of the eighth transistor M8 may be coupled to the first terminal of the sixth transistor M6. In some embodiments, the first terminal of the first capacitor C1 may be coupled to the second terminal of the third transistor M3, and the second terminal of the first capacitor C1 may be coupled to the first terminal of the eighth transistor M8. In addition, in some embodiments, a control terminal of the seventh transistor M7 may be coupled to the reset signal terminal RESET, a first terminal of the seventh transistor M7 may be coupled to the second voltage signal terminal Vint, and a second terminal of the seventh transistor M7 may be coupled to the first terminal of the light-emitting element OLED.

The operation timing sequence of the pixel driving circuit 600 is similar to that of the pixel driving circuit 200 as shown in FIG. 2, and therefore will not be described again herein. The electrostatic discharge sub-circuit 620 may also achieve the electrostatic protection function, improving the electrostatic protection performance of the OLED product during production, testing and/or transportation.

Figure 7:
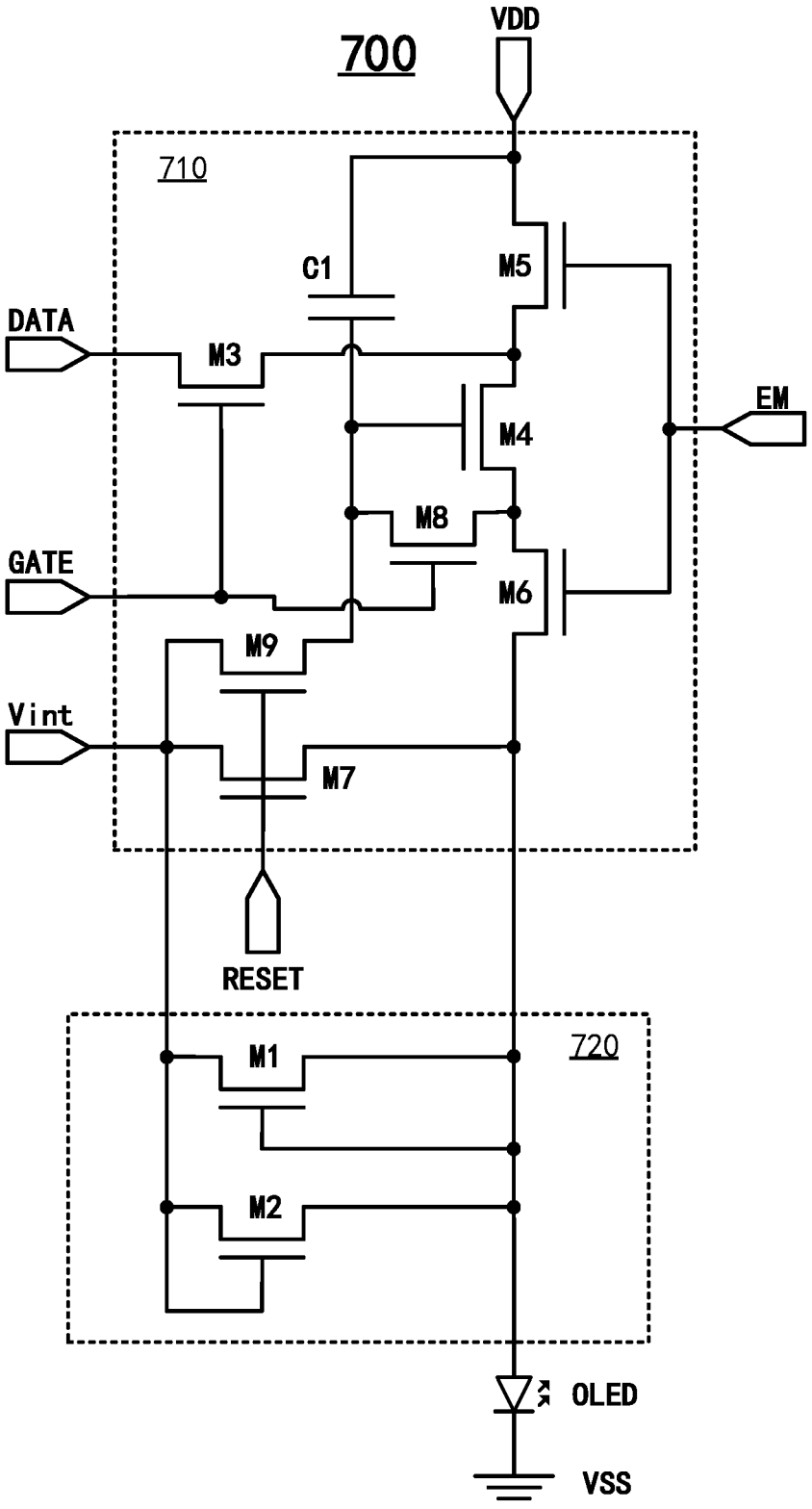
FIG. 7 is a schematic diagram illustrating yet another exemplary specific structure of the pixel driving circuit as shown in FIG. 1.

Next, a structure of an exemplary pixel driving circuit according to yet another embodiment of the present disclosure will be described with reference to FIG. 7. FIG. 7 is a schematic diagram showing yet another exemplary specific structure 700 of the pixel driving circuit 100 as shown in FIG. 1. Compared with the pixel driving circuit 200 as shown in FIG. 2 and the pixel driving circuit 600 as shown in FIG. 6, the pixel driving circuit 700 of FIG. 7 uses a 9T1C configuration, in which the electrostatic discharge sub-circuit 720 is substantially the same as the electrostatic discharge sub-circuits 220 and 620, but the driving sub-circuit 710 is different from the driving sub-circuits 210 and 610. For brevity and clarity, only the differences between the pixel driving circuit 700 and the pixel driving circuit 200 or 600 will be described below.

As shown in FIG. 7, the driving sub-circuit 710 may include a third transistor M3 to a ninth transistor M9. In some embodiments, a control terminal of the third transistor M3 may be coupled to the scanning signal terminal GATE, a first terminal of the third transistor M3 may be coupled to the data signal terminal DATA, and a second terminal of the third transistor M3 may be coupled to a first terminal of the fourth transistor M4. In some embodiments, a control terminal of the fourth transistor M4 may be coupled to a first terminal of the first capacitor C1, the first terminal of the fourth transistor M4 may be coupled to the second terminal of the fifth transistor M5, and a second terminal of the fourth transistor M4 may be coupled to a first terminal of the sixth transistor M6. In some embodiments, a control terminal of the fifth transistor M5 may be coupled to the light-emitting control signal terminal EM, a first terminal of the fifth transistor M5 may be coupled to the first voltage signal terminal VDD, and the second terminal of the fifth transistor M5 may be coupled to the first terminal of the fourth transistor M4. In some embodiments, a control terminal of the sixth transistor M6 may be coupled to the light-emitting control signal terminal EM, the first terminal of the sixth transistor M6 may be coupled to the second terminal of the fourth transistor M4, and a second terminal of the sixth transistor M6 may be coupled to the first terminal of the light-emitting element OLED. In some embodiments, a control terminal of the eighth transistor M8 may be coupled to the scanning signal terminal GATE, a first terminal of the eighth transistor M8 may be coupled to the first terminal of the first capacitor C1, and a second terminal of the eighth transistor M8 may be coupled to the first terminal of the sixth transistor M6. In some embodiments, the first terminal of the first capacitor C1 may be coupled to the control terminal of the fourth transistor M4, and a second terminal of the first capacitor C1 may be coupled to the first voltage signal terminal VDD. In addition, in some embodiments, a control terminal of the seventh transistor M7 may be coupled to the reset signal terminal RESET, a first terminal of the seventh transistor M7 may be coupled to the second voltage signal terminal Vint, and a second terminal of the seventh transistor M7 may be coupled to the first terminal of the light-emitting element OLED. In some embodiments, a control terminal of the ninth transistor M9 may be coupled to the reset signal terminal RESET, a first terminal of the ninth transistor M9 may be coupled to the second voltage signal terminal Vint, and a second terminal of the ninth transistor M9 may be coupled to the first terminal of the first capacitor C1.

Similarly, the operation timing sequence of the pixel driving circuit 700 is similar to that of the pixel driving circuit 200 as shown in FIG. 2 and/or that of the pixel driving circuit 600 as shown in FIG. 6, and therefore will not be described again herein. The electrostatic discharge sub-circuit 720 may also achieve the electrostatic protection function, improving the electrostatic protection performance of the OLED product during production, testing and/or transportation.

Figure 8:
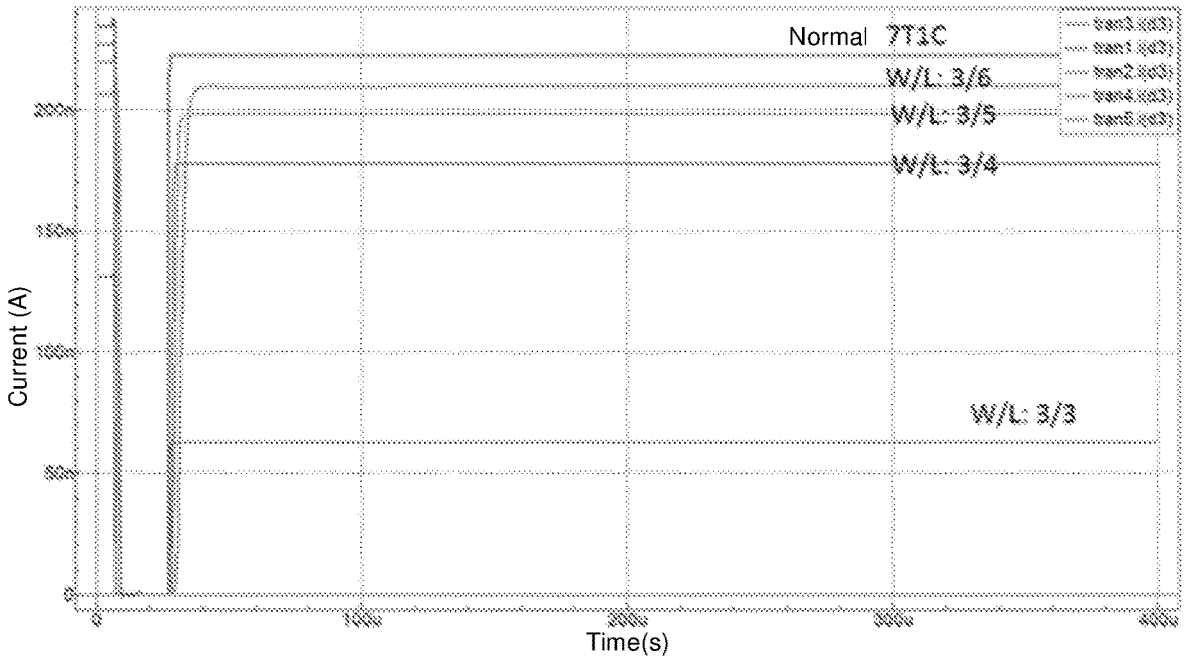
FIG. 8 is a comparative diagram illustrating an OLED driving current in a case where pixel driving circuits with different transistor aspect ratios according to an embodiment of the present disclosure are used.

In addition, as described above, there may be a slight electric leakage problem at the first transistor M1 and/or the second transistor M2 in the electrostatic discharge sub-circuit. Hereinafter, how to solve or at least alleviate this problem will be described in detail with reference to FIG. 8. FIG. 8 is a comparative diagram illustrating an OLED driving current in a case where pixel driving circuits with different transistor aspect ratios according to an embodiment of the present disclosure are used.

OLED driving currents in five cases are respectively shown in FIG. 8. These five cases include a normal 7T1C pixel driving circuit (e.g., the driving sub-circuit 710 of the 9T1C pixel driving circuit 700 in FIG. 7) that does not use the electrostatic discharge sub-circuit according to the embodiment of the present disclosure, and pixel driving circuits that use the electrostatic discharge sub-circuits according to the embodiment of the present disclosure having transistors (e.g., the first transistor M1 and the second transistor M2) with four different aspect ratios.

As may be clearly seen from FIG. 8, when the transistor in the electrostatic discharge sub-circuit has, e.g., an aspect ratio of 3/3 (i.e., a width of 3 μm and a length of 3 μm), the driving current in the pixel driving circuit is much smaller than that in the normal pixel driving circuit, and there is an obvious leakage current, which thus causes higher energy consumption and display performance degradation. As the aspect ratio decreases from 3/3 (i.e., a width of 3 μm and a length of 3 μm) to 3/4 (i.e., a width of 3 μm and a length of 4 μm), 3/5 (i.e., a width of 3 μm and a length of 5 μm), until it decreases to 3/6 (i.e., a width of 3 μm and a length of 6 μm), the driving current gradually increases, and is almost close to the driving current of the normal 7T1C pixel driving circuit at the aspect ratio 3/6. At this time, the leakage current is already very small. Therefore, by adjusting the aspect ratio of the transistor in the electrostatic discharge sub-circuit, the leakage current may be well controlled.

Hereinafter, a method for driving a pixel driving circuit according to an embodiment of the present disclosure will be described in detail with reference to FIG. 9.

Figure 9:
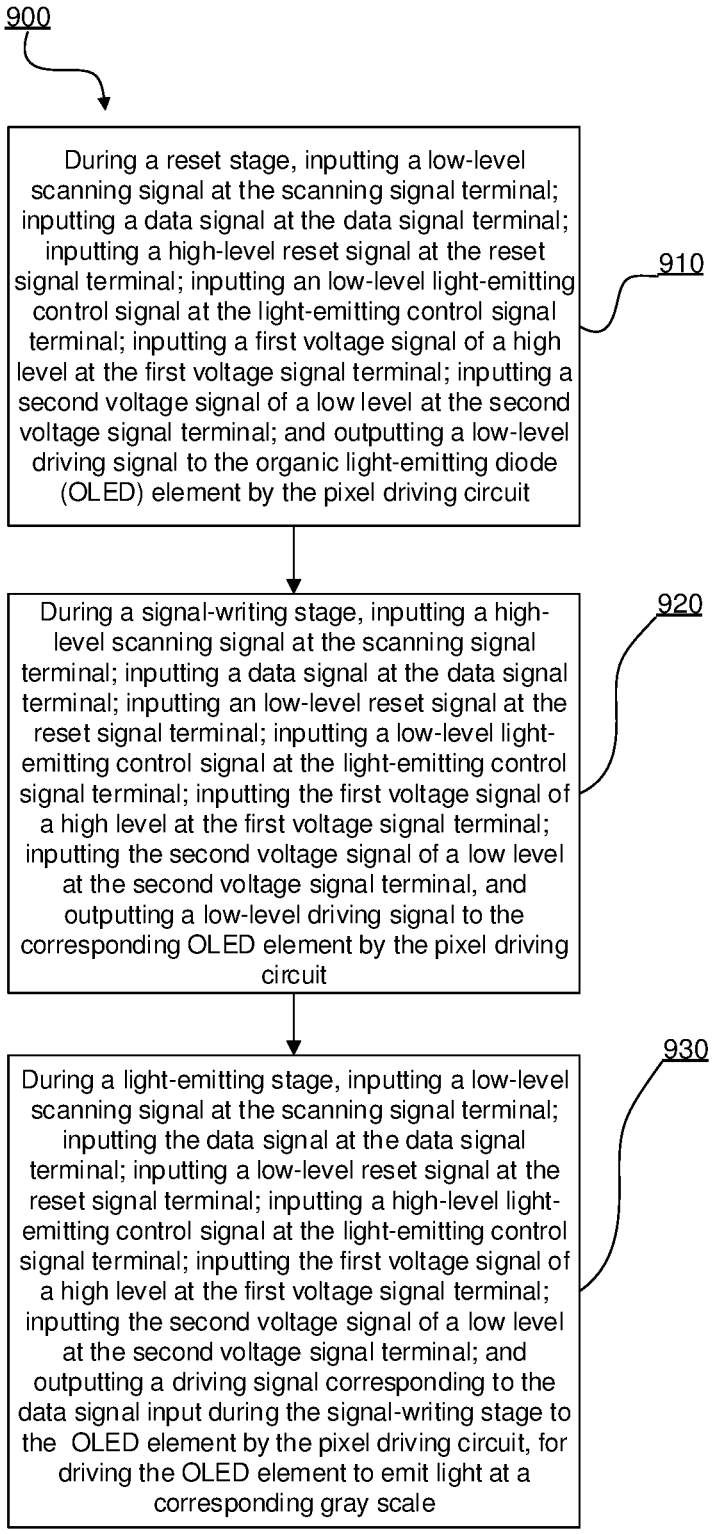
FIG. 9 is a flowchart illustrating an exemplary method for driving a pixel driving circuit according to an embodiment of the present disclosure.

FIG. 9 is a flowchart illustrating an exemplary method 900 for driving the pixel driving circuits 200, 600, and/or 700 according to an embodiment of the present disclosure. As shown in FIG. 9, the method 900 may include steps S910, S920, and S930. According to the present disclosure, some steps of the method 900 may be performed individually or in combination, and may be performed in parallel or sequentially, but is not limited to the specific operation order as shown in FIG. 9. In some embodiments, the method 900 may be performed by the pixel driving circuit described herein or another external device. Hereinafter, the description is performed in conjunction with an example in which the transistors are N-type transistors, the inactive level is a low level, and the active level is a high level.

The method 900 may start at step S910. During the reset stage, a low-level scanning signal may be input at the scanning signal terminal; a data signal may be input at the data signal terminal; a high-level reset signal may be input at the reset signal terminal; a low-level light-emitting control signal may be input at the light-emitting control signal terminal; a first voltage signal of a high level may be input at the first voltage signal terminal; a second voltage signal of a low level may be input at the second voltage signal terminal; and a low-level driving signal may be output to the corresponding light-emitting element (e.g., OLED element) by the pixel driving circuit.

In step S920, during the signal writing stage, a high-level scanning signal may be input at the scanning signal terminal; a data signal may be input at the data signal terminal; a low-level reset signal may be input at the reset signal terminal; a low-level light-emitting control signal may be input at the light-emitting control signal terminal; the first voltage signal of a high level may be input at the first voltage signal terminal; the second voltage signal of a low level may be input at the second voltage signal terminal, and a low-level driving signal may be output to the corresponding OLED element by the pixel driving circuit.

In step S930, during the light-emitting stage, a low-level scanning signal may be input at the scanning signal terminal, a data signal may be input at the data signal terminal; a low-level reset signal may be input at the reset signal terminal; a high-level light-emitting control signal may be input at the light-emitting control signal terminal; the first voltage signal of a high level may be input at the first voltage signal terminal; the second voltage signal of a low level may be input at the second voltage signal terminal; and a driving signal corresponding to the data signal input during the signal-writing stage may be output to the OLED element by the pixel driving circuit, for driving the OLED element to emit light at the corresponding gray scale.

In addition, in some embodiments, the method 900 may further include: conducting the static electricity out of the second voltage signal terminal by the electrostatic discharge sub-circuit of the pixel driving circuit in response to the static electricity generated between the light-emitting element and the pixel driving circuit.

Figure 10:
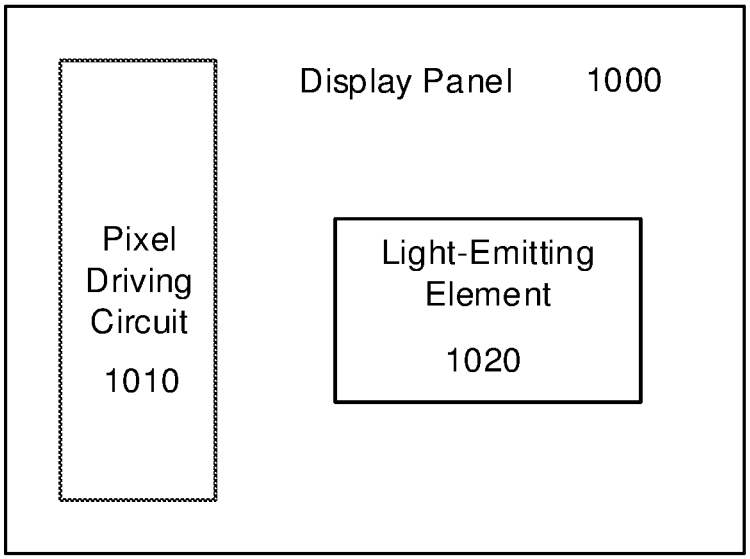
FIG. 10 is a schematic structural diagram of a display panel according to an embodiment of the present disclosure.

In addition, according to some embodiments of the present disclosure, a display panel is also provided. As shown in FIG. 10, the display device 1000 may include any one or more of pixel driving circuits 1010 as described above and a light-emitting element 1020.

Figure 11:
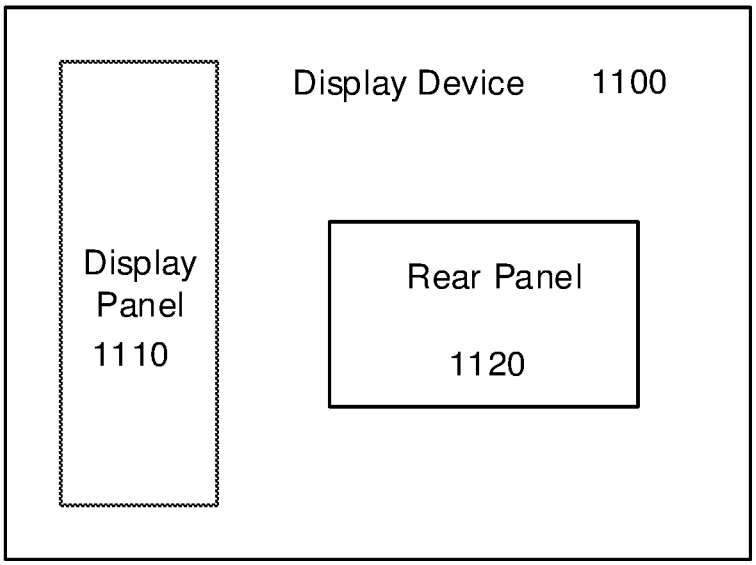
FIG. 11 is a schematic structural diagram of a display device according to an embodiment of the present disclosure.

In addition, according to some embodiments of the present disclosure, a display device is also provided. As shown in FIG. 11, the display device 1100 may include a display panel 1110 as described above and a rear panel 1120.

By using the pixel driving circuit and the driving method thereof, the display panel, and the display device according to the embodiments of the present disclosure, it is possible to effectively release the static electricity when the static electricity is generated in the pixel driving circuit or the OLED element, and to avoid the possible damage to the OLED display by the static electricity during production and/or testing, thereby improving the product yield and reducing the production cost.

The present disclosure has been described so far in connection with the preferred embodiments. It should be understood that those skilled in the art may make various other changes, substitutions, and additions without departing from the spirit and scope of the present disclosure. Therefore, the scope of the present disclosure is not limited to the specific embodiments described above, but should be defined by the appended claims.

In addition, the functions described in this document as implemented by pure hardware, pure software, and/or firmware may also be implemented by means of a combination of dedicated hardware, general-purpose hardware and software. For example, functions that are described as being implemented by dedicated hardware (e.g., Field Programmable Gate Array (FPGA), Application Specific Integrated Circuit (ASIC), etc.) may be implemented by means of a combination of general-purpose hardware (e.g., Central Processing Unit (CPU), Digital Signal Processing (DSP)) and software, and vice versa.

We claim:

1. A pixel driving circuit, comprising:

a driving sub-circuit, coupled to a scanning signal terminal, a data signal terminal, a light-emitting control signal terminal, a first voltage signal terminal, and a first terminal of a light-emitting element, and configured to be able to output a first voltage signal from the first voltage signal terminal to the light-emitting element under the control of a scanning signal from the scanning signal terminal, a data signal from the data signal terminal, and a light-emitting control signal from the light-emitting control signal terminal; and an electrostatic discharge sub-circuit, coupled to a second voltage signal terminal and the first terminal of the light-emitting element, and configured to be able to conduct static electricity to the second voltage signal terminal in response to the static electricity generated at the first terminal of the light-emitting element.

2. The pixel driving circuit according to claim 1, wherein the electrostatic discharge sub-circuit comprises:

a first transistor, having a control terminal and a first terminal coupled to the first terminal of the light-emitting element, and a second terminal coupled to the second voltage signal terminal.

3. The pixel driving circuit according to claim 2, wherein the electrostatic discharge sub-circuit further comprises:

a second transistor, having a control terminal and a first terminal coupled to the second voltage signal terminal, and a second terminal coupled to the first terminal of the light-emitting element.

4. The pixel driving circuit according to claim 1, wherein the driving sub-circuit comprises:

a third transistor, having a control terminal coupled to the scanning signal terminal, a first terminal coupled to the data signal terminal, and a second terminal coupled to a control terminal of a fourth transistor;

the fourth transistor, having the control terminal coupled to the second terminal of the third transistor, a first terminal coupled to a second terminal of a fifth transistor, and a second terminal coupled to a first terminal of a sixth transistor;

the fifth transistor, having a control terminal coupled to the light-emitting control signal terminal, a first terminal coupled to the first voltage signal terminal, and the second terminal coupled to the first terminal of the fourth transistor;

the sixth transistor, having a control terminal coupled to the light-emitting control signal terminal, the first terminal coupled to the second terminal of the fourth transistor, and a second terminal coupled to the first terminal of the light-emitting element; and a first capacitor, having a first terminal coupled to the second terminal of the third transistor, and a second terminal coupled to the first voltage signal terminal.

5. The pixel driving circuit according to claim 1, wherein the driving sub-circuit comprises:

a third transistor, having a control terminal coupled to the scanning signal terminal, a first terminal coupled to the data signal terminal, and a second terminal coupled to a first terminal of a first capacitor;

a fourth transistor, having a control terminal coupled to a second terminal of the first capacitor, a first terminal coupled to the first voltage signal terminal, and a second terminal coupled to a first terminal of a sixth transistor;

a fifth transistor, having a control terminal coupled to the light-emitting control signal terminal, a first terminal coupled to the first voltage signal terminal, and a second terminal coupled to the first terminal of the first capacitor;

the sixth transistor, having a control terminal coupled to the light-emitting control signal terminal, the first terminal coupled to the second terminal of the fourth transistor, and a second terminal coupled to the first terminal of the light-emitting element;

an eighth transistor, having a control terminal coupled to the scanning signal terminal, a first terminal coupled to the second terminal of the first capacitor, and a second terminal coupled to the first terminal of the sixth transistor; and the first capacitor, having the first terminal coupled to the second terminal of the third transistor, and the second terminal coupled to the first terminal of the eighth transistor.

6. The pixel driving circuit according to claim 4, wherein the driving sub-circuit is further coupled to a reset signal terminal and the second voltage signal terminal, and configured to be able to output a second voltage signal from the second voltage signal terminal to the light-emitting element under the control of a reset signal from the reset signal terminal.

7. The pixel driving circuit according to claim 6, wherein the driving sub-circuit further comprises:

a seventh transistor, having a control terminal coupled to the reset signal terminal, a first terminal coupled to the second voltage signal terminal, and a second terminal coupled to the first terminal of the light-emitting element.

8. The pixel driving circuit according to claim 5, wherein the driving sub-circuit is further coupled to a reset signal terminal and the second voltage signal terminal, and configured to be able to output a second voltage signal from the second voltage signal terminal to the light-emitting element under the control of a reset signal from the reset signal terminal.

9. The pixel driving circuit according to claim 8, wherein the driving sub-circuit further comprises:

a seventh transistor, having a control terminal coupled to the reset signal terminal, a first terminal coupled to the second voltage signal terminal, and a second terminal coupled to the first terminal of the light-emitting element.

10. The pixel driving circuit according to claim 1, wherein the driving sub-circuit comprises:

a third transistor, having a control terminal coupled to the scanning signal terminal, a first terminal coupled to the data signal terminal, and a second terminal coupled to a first terminal of a fourth transistor;

the fourth transistor, having a control terminal coupled to a first terminal of a first capacitor, the first terminal coupled to a second terminal of a fifth transistor, and a second terminal coupled to a first terminal of a sixth transistor;

the fifth transistor, having a control terminal coupled to the light-emitting control signal terminal, a first terminal coupled to the first voltage signal terminal, and the second terminal coupled to the first terminal of the fourth transistor;

the sixth transistor, having a control terminal coupled to the light-emitting control signal terminal, the first terminal coupled to the second terminal of the fourth transistor, and a second terminal coupled to the first terminal of the light-emitting element;

an eighth transistor, having a control terminal coupled to the scanning signal terminal, a first terminal coupled to the first terminal of the first capacitor, and a second terminal coupled to the first terminal of the sixth transistor; and the first capacitor, having the first terminal coupled to the control terminal of the fourth transistor, and the second terminal coupled to the first voltage signal terminal.

11. The pixel driving circuit according to claim 10, wherein the driving sub-circuit is further coupled to a reset signal terminal and the second voltage signal terminal, and configured to be able to output a second voltage signal from the second voltage signal terminal to the light-emitting element under the control of a reset signal from the reset signal terminal.

12. The pixel driving circuit according to claim 11, wherein the driving sub-circuit further comprises:

a seventh transistor, having a control terminal coupled to the reset signal terminal, a first terminal coupled to the second voltage signal terminal, and a second terminal coupled to the first terminal of the light-emitting element; and a ninth transistor, having a control terminal coupled to the reset signal terminal, a first terminal coupled to the second voltage signal terminal, and a second terminal coupled to the first terminal of the first capacitor.

13. The pixel driving circuit according to claim 1, wherein each transistor in the pixel driving circuit is an N-type transistor, the first voltage signal from the first voltage signal terminal is a high-level signal, and the second voltage signal from the second voltage signal terminal is a low-level signal.

14. The pixel driving circuit according to claim 3, wherein an aspect ratio of a channel of each of the first transistor and the second transistor is 3/6.

15. A display panel comprising the pixel driving circuit according to claim 1 and the light-emitting element.

16. The display panel according to claim 15, further comprising: a low-level voltage signal terminal of a mesh structure for providing a low level and being coupled to a cathode of the light-emitting element.

17. The display panel according to claim 16, further comprising: an electrostatic circuit coupled to the low-level signal terminal and the second voltage signal terminal, wherein the electrostatic circuit comprises unidirectional elements connected in parallel and reversely.

18. A display device comprising the display panel according to claim 15 and a rear panel.

19. A method for driving a pixel driving circuit according to claim 1, comprising, within a period of one frame:

during a reset stage, inputting an inactive-level scanning signal at the scanning signal terminal; inputting a data signal at the data signal terminal; inputting an active-level reset signal at a reset signal terminal; inputting an inactive-level light-emitting control signal at the light-emitting control signal terminal; inputting a first voltage signal of a high level at the first voltage signal terminal; inputting a second voltage signal of a low level at the second voltage signal terminal; and outputting an inactive-level driving signal to the light-emitting element by the pixel driving circuit;

during a signal-writing stage, inputting an active-level scanning signal at the scanning signal terminal; inputting a data signal at the data signal terminal; inputting an inactive-level reset signal at a reset signal terminal; inputting an inactive-level light-emitting control signal at the light-emitting control signal terminal; inputting the first voltage signal of a high level at the first voltage signal terminal; inputting the second voltage signal of a low level at the second voltage signal terminal, and outputting an inactive-level driving signal to the light-emitting element by the pixel driving circuit; and during a light-emitting stage, inputting an inactive-level scanning signal at the scanning signal terminal, inputting a data signal at the data signal terminal; inputting an inactive-level reset signal at the reset signal terminal; inputting an active-level light-emitting control signal at the light-emitting control signal terminal; inputting the first voltage signal of a high level at the first voltage signal terminal; inputting the second voltage signal of a low level at the second voltage signal terminal; and outputting a driving signal corresponding to the data signal input during the signal-writing stage to the light-emitting element by the pixel driving circuit, for driving the light-emitting element to emit light at a corresponding gray scale.

20. The method according to claim 19, further comprising:

conducting static electricity out of the second voltage signal terminal by the electrostatic discharge sub-circuit of the pixel driving circuit in response to the static electricity generated between the light-emitting element and the pixel driving circuit.

* * * * *